US006662416B1

(12) United States Patent
Huggins

(10) Patent No.: US 6,662,416 B1
(45) Date of Patent: Dec. 16, 2003

(54) ARTIFICIAL UNDERWATER MEMORIALIZING CATACOMB AND REEF SYSTEM

(76) Inventor: Morris Huggins, 404 NE. 2nd St., Delray Beach, FL (US) 33484

( * ) Notice: Subject to any disclaimer, the term of this patent is extended or adjusted under 35 U.S.C. 154(b) by 0 days.

(21) Appl. No.: 09/928,006

(22) Filed: Aug. 10, 2001

(51) Int. Cl.[7] ..... A61G 17/00
(52) U.S. Cl. ..... 27/1; 52/134
(58) Field of Search ..... 27/1; 405/25, 33, 405/210; 52/134, 136

(56) References Cited

U.S. PATENT DOCUMENTS

| | | | | | |
|---|---|---|---|---|---|
| 923,975 | A | | 6/1909 | Johnston | |
| 2,069,715 | A | | 2/1937 | Arpin | |
| 3,732,602 | A | | 5/1973 | Vigh | |
| 3,754,805 | A | * | 8/1973 | Pangburn et al. | 211/84 |
| 3,886,751 | A | | 6/1975 | Porraz Jimenez | |
| 3,925,944 | A | * | 12/1975 | Pickel | 52/133 |
| 3,990,198 | A | | 11/1976 | Ortutay | |
| 4,316,431 | A | | 2/1982 | Kimura | |
| 4,344,796 | A | | 8/1982 | Minnick | |
| 4,521,999 | A | * | 6/1985 | Flanagan | 52/103 |
| 4,818,141 | A | | 4/1989 | Rauch | |
| 5,071,285 | A | | 12/1991 | Van Doren | |
| 5,120,156 | A | | 6/1992 | Rauch | |
| 5,215,406 | A | | 6/1993 | Hudson | |
| 5,246,307 | A | | 9/1993 | Rauch | |
| 5,287,603 | A | * | 2/1994 | Schorman | 27/1 |
| 5,371,984 | A | * | 12/1994 | Taylor | 27/30 |
| 5,556,228 | A | | 9/1996 | Smith | |
| 5,740,637 | A | * | 4/1998 | Snow | 27/1 |
| 5,765,269 | A | * | 6/1998 | Zarth | 27/26 |
| 5,803,660 | A | | 9/1998 | Warren et al. | |
| 5,890,836 | A | | 4/1999 | Leech | |
| 5,908,265 | A | | 6/1999 | Mostoff | |
| 6,052,954 | A | * | 4/2000 | Dudek et al. | 27/7 |
| 6,079,902 | A | | 6/2000 | Pettee, Jr. | |
| 6,161,268 | A | * | 12/2000 | Joseph | 27/1 |
| 6,167,600 | B1 | * | 1/2001 | Williams et al. | 27/1 |
| 6,189,188 | B1 | | 2/2001 | O'Hare | |
| 6,261,028 | B1 | * | 7/2001 | Volpe et al. | 27/1 |
| 6,421,890 | B1 | * | 7/2002 | Biggar | 220/23.83 |
| 6,493,911 | B1 | * | 12/2002 | Troin et al. | 27/1 |

FOREIGN PATENT DOCUMENTS

| | | | |
|---|---|---|---|
| DE | 298 02 236 A1 | * | 6/1998 |
| DE | 100 01 506 A1 | * | 7/2001 |
| FR | 2722229 A1 | * | 1/1996 |
| GB | 2238062 A | * | 5/1991 |
| GB | 2313587 A | * | 12/1997 |
| WO | WO-02/25037 A1 | * | 3/2002 |

* cited by examiner

*Primary Examiner*—Willam Miller
(74) *Attorney, Agent, or Firm*—Malin, Haley & DiMaggio, P.A.

(57) ABSTRACT

An artificial underwater memorializing catacomb and reef system and evocative environment for a visitor is made from one or more urns containing cremated remains imbedded at least partway within a plurality of concrete forms, whereby the concrete forms are interlocked and/or stacked to form the catacomb. The catacomb includes tunnels and underwater enclosed spaces accessible to visitors. The tunnels and the enclosed spaces may be accessed by intermediate openings or through tunnel entrances. The catacomb is formed by mixing a concrete mixture, placing one or more molds for the forms on a vessel and pouring the mixture into the molds. One or more urns containing cremated remains is then interposed at least partway within the molds before the mixture sets, thereby forming one or more concrete forms when the mixture sets. The mixture is allowed to set, and the concrete forms are placed underwater in a stacked and interlocking orientation.

24 Claims, 6 Drawing Sheets

ARTIFICIAL UNDERWATER MEMORIALIZING CATACOMB AND REEF SYSTEM

BACKGROUND OF THE INVENTION

1. Field of the Invention

This invention relates generally to an artificial underwater catacomb and modular reef made of discrete, interlocking modules manufactured using concrete forms. A module or catacomb section can contain one or more urns for memorializing a person and providing an evocative environment for a visitor either diving or snorkeling. The invention also relates to a rapid and efficient method for manufacturing and installing the artificial underwater catacomb.

2. Description of Related Art

Artificial reefs are generally known for preventing or controlling beach erosion, as well as providing environmentally compatible structures for attracting marine life, and fostering aquatic habitats. These reefs are used for the both greater enjoyment of coastal recreation by preserving sandy beaches and minimizing expensive and difficult reclamation projects, and in other applications to provide structure for underwater recreation by simulating a natural reef, with fish, coral, plant life, and other aquatic life forms which develop about the artificial structure.

Also, the combination of burial at sea and the cremation of human remains has been known since the tradition of the Vikings funerals, wherein the deceased was placed in a burning boat. Moreover, the burial at sea of human cremated remains is also known in modern times. In U.S. Pat. No. 3,732,602 to Vigh, human cremated remains are placed in biodegradable urns, so the deceased eventually is washed away into the sea.

In U.S. Pat. No. 6,189,188 to O'Hare, a memorial in the form of an artificial reef is taught which consist of modular units. The units incorporate human remains into a cement mixture, so the units together provide a memorial in a marine environment. In O'Hare, the remains are mixed into cement mixtures to be poured into receptacles in the reef forms.

While O'Hare provides a reef that acts as a memorial for human remains, O'Hare does not teach the construction of catacombs, which are an attraction for both divers and marine life, and which evoke an emotional reaction in underwater visitors. O'Hare also does not teach underwater tunnels or enclosed spaces accessible to underwater visitors. Moreover, O'Hare does not teach the use of urns that are provided with the remains. If the bereaved uses the remains in O'Hare, or otherwise scatters the remains, then the urn will remain as an unnecessary and inappropriate memorial. Furthermore, O'Hare does not teach a rapid and efficient method for creating an artificial catacomb.

Consequently, a need exists for the use of the remains together with the urn in a memorial that is appropriate for someone who loved the sea. A need also exists for the creation of a catacomb, which would be attractive to visitors to the remains as well as visitors to a marine environment. Also, the need exists for a creation of an evocative underwater structure so the visitors and divers are moved toward an appreciation for the number of people who loved the sea and for our rapidly disappearing marine resources. Underwater tunnels, passageways and enclosed spaces are also needed to heighten the experience for an underwater visitor, and uniquely combine the salient features of personal memorial, artificial reef, and catacomb system. Also, a need exists for an efficient and rapid method for creating the catacomb to keep costs of construction as low as possible.

THEREFORE, an important object of the invention is to provide an interesting and appropriate resting place for the remains of a person and the urn commonly used for containing the remains into a module which forms the basis of a structure which is attractive to divers and marine wildlife.

Another object is to provide underwater passageways, enclosed spaces, catacombs and mazes that are ornamentally pleasing and evocative to divers and snorkelers.

It is also an object of this invention to provide a interesting theme park habitat attractive to marine wildlife and marine enthusiasts alike.

It is also an object of this invention to provide a unique maze of intersecting passageways to amplify the wonder felt by a diver or snorkeler inside a passageway.

BRIEF SUMMARY OF THE INVENTION

The present invention provides an appropriate use for the remains and urn of a loved one, whether a person or a pet, a respected member of society, or simply someone who loved the sea. The present invention also creates an underwater catacomb attractive to all types of visitors. In one embodiment the artificial reef system includes arched passageways, with unique ingress and egress portals, while simultaneously incorporating the memorial urn in select reef modules. The catacomb is evocative, so that visitors become more appreciative of those who love the sea and of our rapidly diminishing marine resources. The underwater system can portray visually stimulating designs, which could be viewed from glass bottom boats. The catacomb also includes tunnels and enclosed areas accessible to snorkelers and scuba divers. The present invention also provides an efficient and rapid method for creating the catacomb. The present invention also provides an evocative underwater theme park and attraction, which includes the feature of a conventional memorial.

In one embodiment, the present invention is an artificial underwater catacomb for memorializing a person and providing an evocative environment for a visitor, including one or more urns containing cremated remains imbedded at least partway within a plurality of concrete modules, which constitute discrete pieces manufactured using concrete forms. The concrete modules are interlocking, and can be stacked to form structural support, columns or end caps for the catacomb. The modules also can be assembled to construct the walls, tunnels or passageways, ceilings, arches or portals for the submerged ducts. More than one urn may be imbedded in each concrete module or segment. The module can be marked to indicate the identity of the remains within the imbedded urn. In another embodiment, the catacomb includes tunnels that branch into an enclosed underwater area or maze.

In another embodiment, the invention is a concrete article comprising a concrete segment and at least one cavity therein containing at least partway an urn containing cremated remains. The article comprises a shape whereby it can be interlocked with an adjacent piece or stacked with other articles to form an underwater structure, such as a catacomb with tunnels and nooks. The articles can be planar or curved, and of varying dimensions. Any particular tunnel section can include various portals, such that a diver can enter and leave the catacomb at different locations. This design also facilitates the development of aquatic life, and the creation of unique, visually stimulating artificial reefs with theme park-like features.

The system allows for the specific identification and location of modules, to memorialize loved-ones. For example, a tunnel section can be dedicated to veterans, or a particular battalion or branch of the armed services. These modules would contain urns, and could also incorporate an insignia, logo, or epitaph on the external surface of that section. In still another embodiment, the invention is a rapid, cost effective and efficient method for creating an artificial underwater catacomb comprising the steps of mixing concrete or a cement mixture, placing one or more concrete molds for interlocking and stacking forms on a floating vessel, and pouring the mixture into one or more concrete molds. One or more urns contains cremated remains, and is interposed at least partway within one or more concrete molds before the mixture sets, thereby forming one or more concrete modules when the mixture sets. If desired, an urn can be completely imbedded into any module. Thereafter, allow the mixture to set and placing the concrete forms underwater in a stacked or interlocking orientation thereby forming an underwater catacomb. In yet another embodiment, the step of placing the concrete forms includes lowering the concrete forms in place with a gantry system aboard the floating vessel.

In accordance with these and other objects which will become apparent hereinafter, the instant invention will now be described with particular reference to the accompanying drawings.

DETAILED DESCRIPTION OF THE INVENTION

Figure 1:
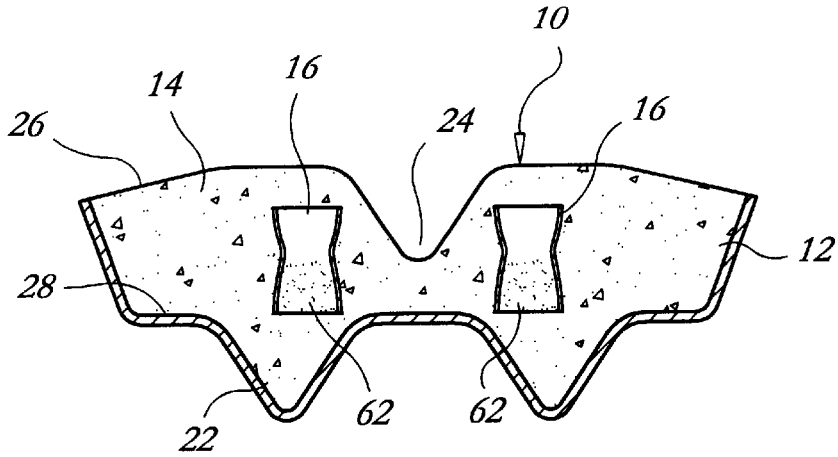
FIG. 1 is a cross-sectional view of the preferred embodiment of the invention.
Figure 2:
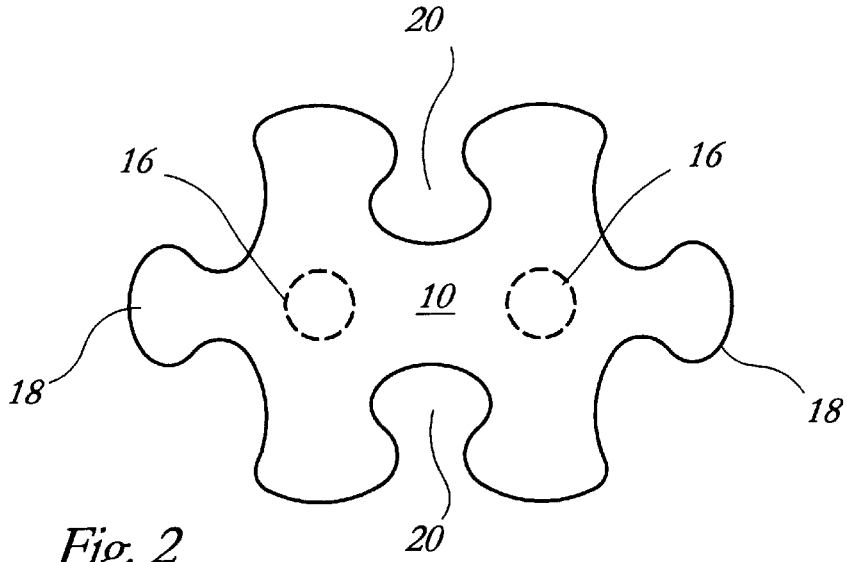
FIG. 2 is a top plan view of the preferred embodiment of a module of the invention.
Figure 3:
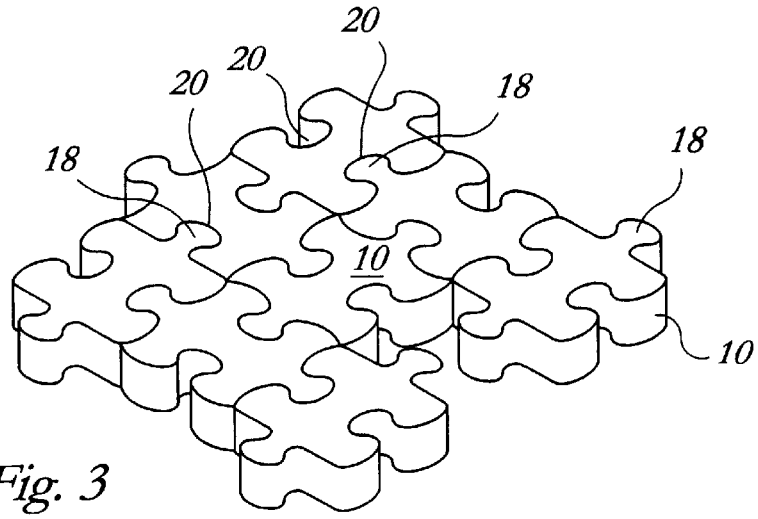
FIG. 3 is a perspective view of the invention as it is interlocked horizontally.

The present invention is a concrete module shown in FIGS. 1 and 2 and described generally at 10. The module 10 is made from known formulations of concrete mixture suitable for the creation of underwater structures generally known in the construction industry. The concrete mixture when prepared to the appropriate consistency is poured into a form 12 to create a medium 14 into which an urn 16 containing cremated remains 62 is placed. The remains can be human or that of a beloved pet. The urn 16 is placed within the medium 14 before the medium 14 fully hardens. The urn 16 is thus at least partway permanently imbedded within the concrete medium 14. In the preferred embodiment, the urn 16 is entirely encased within the concrete medium 14. Once the medium 14 is set, the urn 16 is permanently encased in the medium 14, and the catacomb segment or piece 10 is created. In an alternative embodiment, the external surface of module 10 is marked to identify the remains 62 located therein. The marking may be a name chiseled into the form, a plaque, an epitaph, a logo, or similar inscription.

Figure 4:
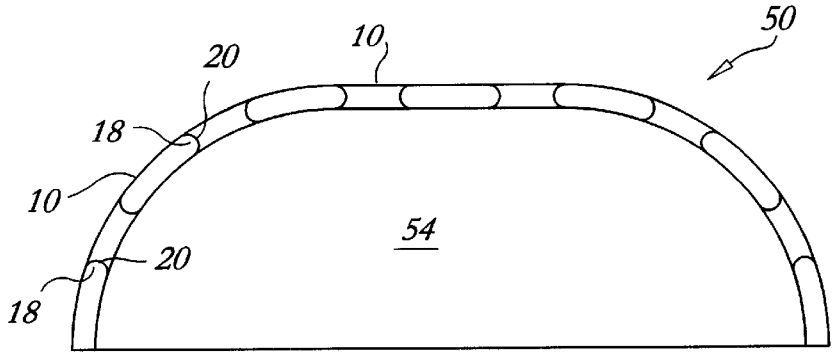
FIG. 4 is an end view of a tunnel in the preferred embodiment of the invention.
Figure 5:
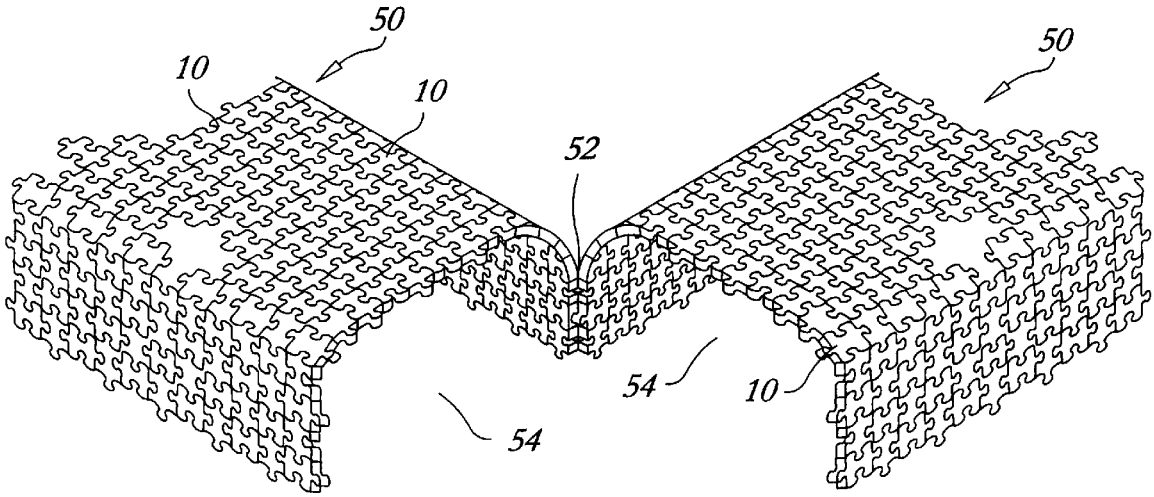
FIG. 5 is a perspective view of an intersection of tunnels in the preferred embodiment of the invention.

The module 10 preferably has an interlocking configuration, as shown in FIGS. 2 through 6. In the preferred embodiment, the interlocking configuration includes one or more horizontal protrusions 18 and one or more peripheral recesses 20. The surfaces are generally smooth, rounded and have consistent transitions to facilitate positioning and construction of catacomb sections. It is important that the concrete forms and molds have precise corresponding components and mating sections for simplifying installation. Furthermore, as illustrated in FIG. 5, the modules may be interlockingly and vertically stacked. Through curvature of the modules 10, vertical stacking can transform into horizontal interlock, thereby forming arches, passageways, enclosed spaces, catacombs and/or mazes.

Figure 7:
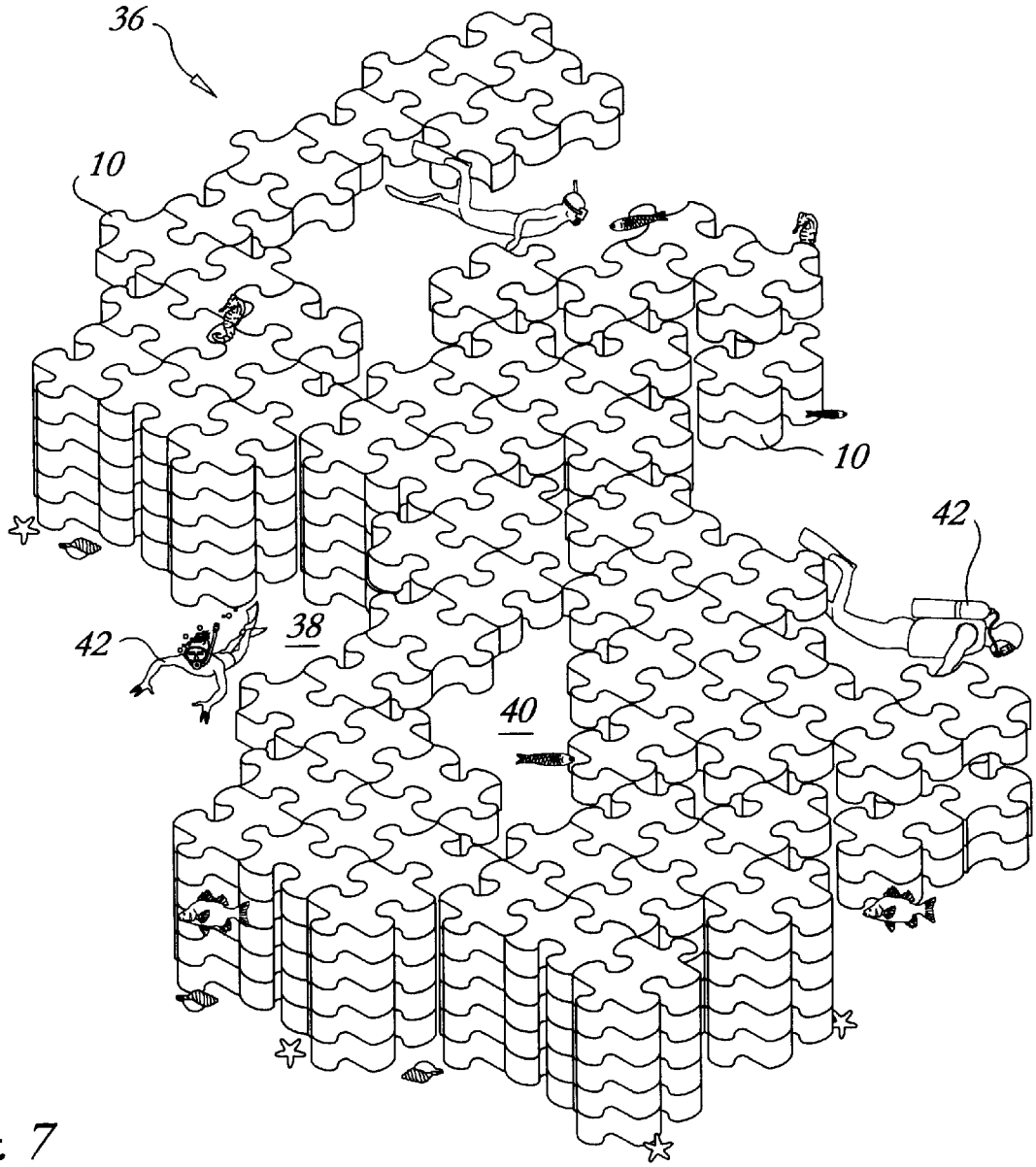
FIG. 7 is a perspective view of an alternative embodiment of the invention.
Figure 8:
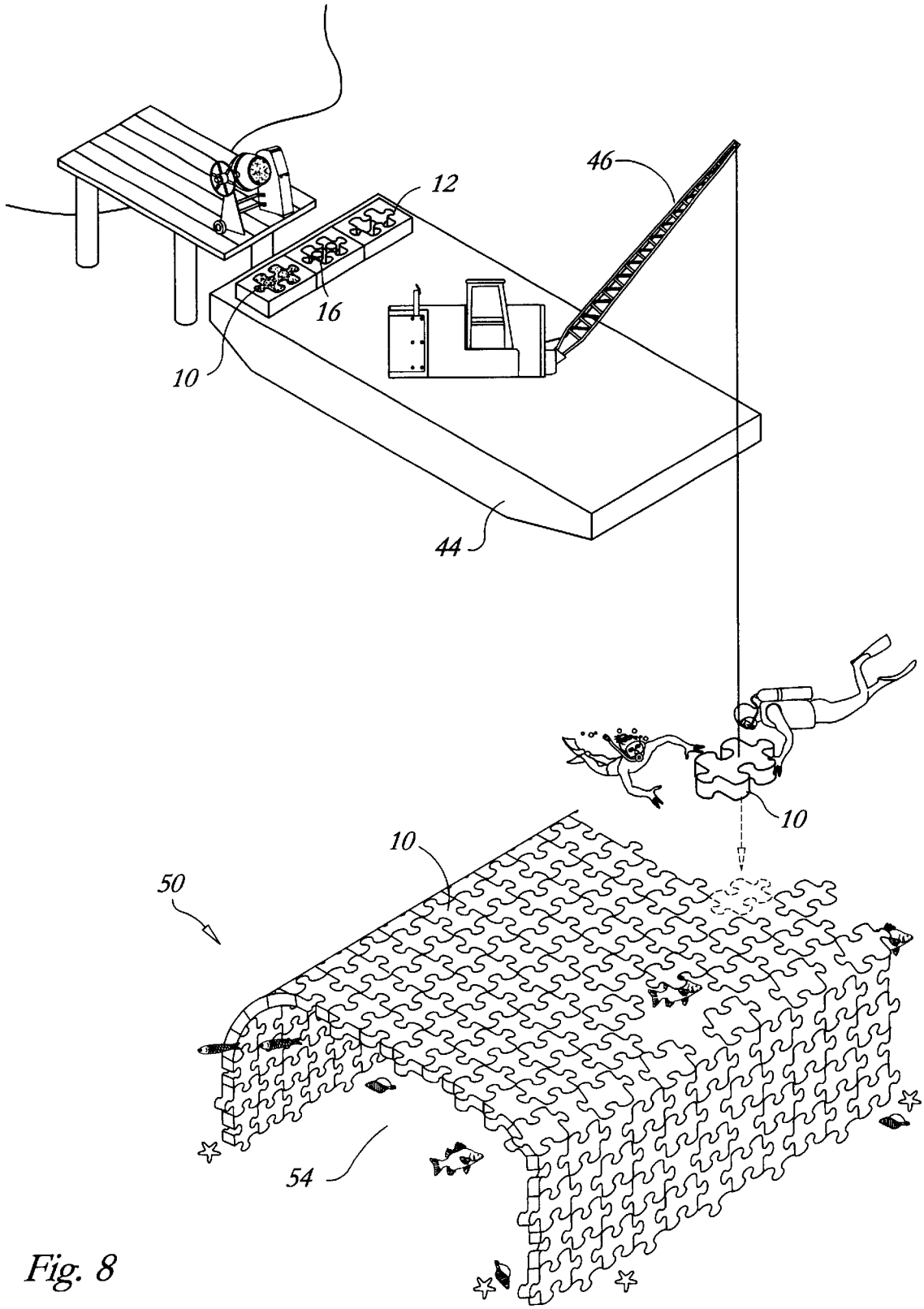
FIG. 8 is a perspective view of the preferred embodiment of the method of the invention.

In an alternative embodiment, the module 10 has a stackable configuration. In this embodiment, as shown in FIGS. 1 and 7, the module 10 includes one or more vertical protrusions 22 and one or more vertical dentations 24. Although FIG. 1 illustrates the vertical dentation 24 on the top portion 26 of the module 10 and the vertical protrusion 22 on the bottom portion 28 of the module 10, the vertical dentation 24 and the vertical protrusion 22 alternatively may be flipped on the module 10. Furthermore, FIGS. 1 and 5 illustrate the use of a curvature in the modules 10 to form arches, passageways, enclosed spaces, catacombs and/or mazes. FIG. 7 illustrates another embodiment in which the vertical dentations 24 and vertical protrusions 22 allow the modules 10 to be stacked to form an underwater catacomb 36 with one or more nooks 38 and tunnels 40. Although in FIG. 7 the modules 10 are shown stacked precisely one on top of the other, the protrusions 22 and the dentations 24 may allow the modules 10 to be stacked in an offset orientation. The catacomb 36 provides an ornamentally pleasing, interesting and evocative environment for a visitor 42 while simultaneously providing a memorial to the deceased person whose remains are embedded in the catacomb segment. As mentioned, an entire section or wing of the maze may be dedicated to a particular group or military division, to commemorate extraordinary achievement or honor. For example, a wall could be reserved for those who gave their life in a particular battle, such as Pearl Harbor or the Gulf War, the latter representing a more recent conflict in American history.

FIG. 4 illustrates a preferred embodiment of the invention, wherein a plurality of modules 10 form a tunnel entrance. The modules 10 are interlocking by their corresponding protrusions 18 and recesses 20. As shown, several catacomb segments are used to create a tunnel 50. The tunnel 50 is of sufficient size to allow a visitor to pass through its interior 54. Both vertical and horizontal pieces are utilized, along with curved pieces to complete arches and transition sections. Alternatively, a passageway may also be created by stacking one or more layers of pieces to create the tunnel 50, or to provide support in the form of a column or end unit. Also, the shape of the tunnel 50 may be of generally rounder or flatter curvature than that illustrated in FIGS. 4 and 5. As understood to one of ordinary skill in the art, the concrete pieces of the instant invention can be utilized to create a variety of different shapes and structures.

Figure 9:
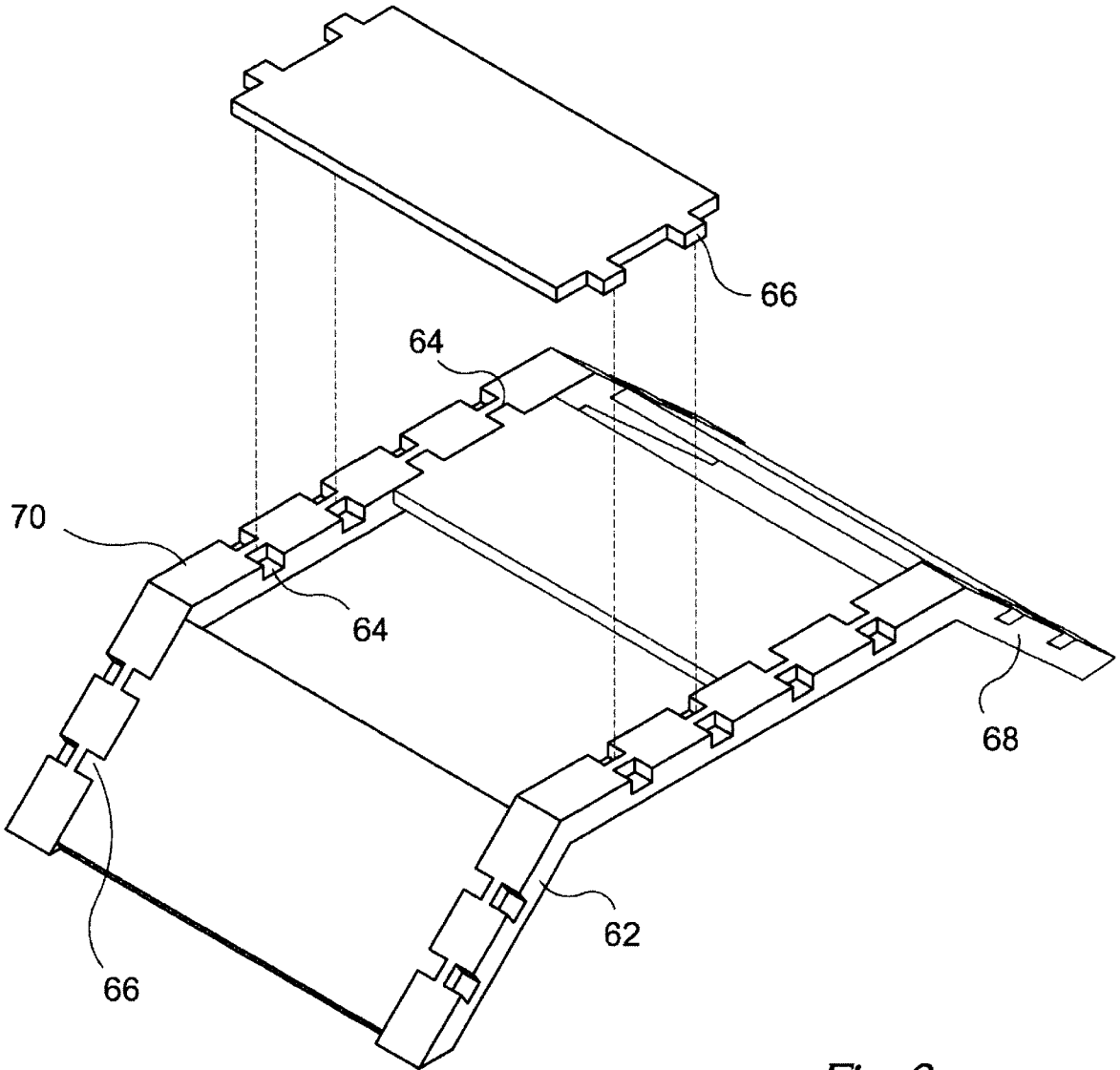
FIG. 9 is a perspective view of an alternative embodiment to the invention.

In another embodiment, shown in FIG. 9, one or more truss assemblies 62 is first is constructed on the seabed. Preferably, this assembly 62 includes dentations 64 for the placement of the modules 10 which are generally slab-shaped and which have projections 66. As shown, the modules 10 may then be placed across the sloped sides 68 of the assembly 62 as well as across the top 70 of the assembly 62. Although a horizontal top 70 of the assembly 62 is shown, other geometric shapes, such as an arc or an entire enclosed area, are also contemplated for the top 70 of the assembly 62. Also, other shapes for the modules 10, such as curves or angles, are also contemplated. As shown, the modules 10 include projections 66 for complementary joining with the dentations 64 on the assembly 62. However, other means for joining the modules 10 with the assembly 62, such as a pin and eye connection, or having the projections on the assembly 62 and dentations on the modules 10, are also contemplated. Assemblies 62 may also be connected to one another to form the framework for tunnels, enclosed areas, catacombs and other underwater structures as modules 10 are attached to the assemblies 62.

FIG. 5 illustrates how a plurality of tunnels 50 may intersect at an intersection point 52. Separate passageways thus may branch off from one another, creating a more interesting experience for a diver exploring the tunnels' interiors 54. More than one intersection point 52 may exist in each catacomb 36. Further, the overall system can be designed to achieve a specific "look from above" for the enjoyment of those viewing the overall system from the vantage point of a glass bottom boat, or the like. Examples include a Crucifix, Star of David, or Army insignia, amongst innumerable others.

Figure 6:
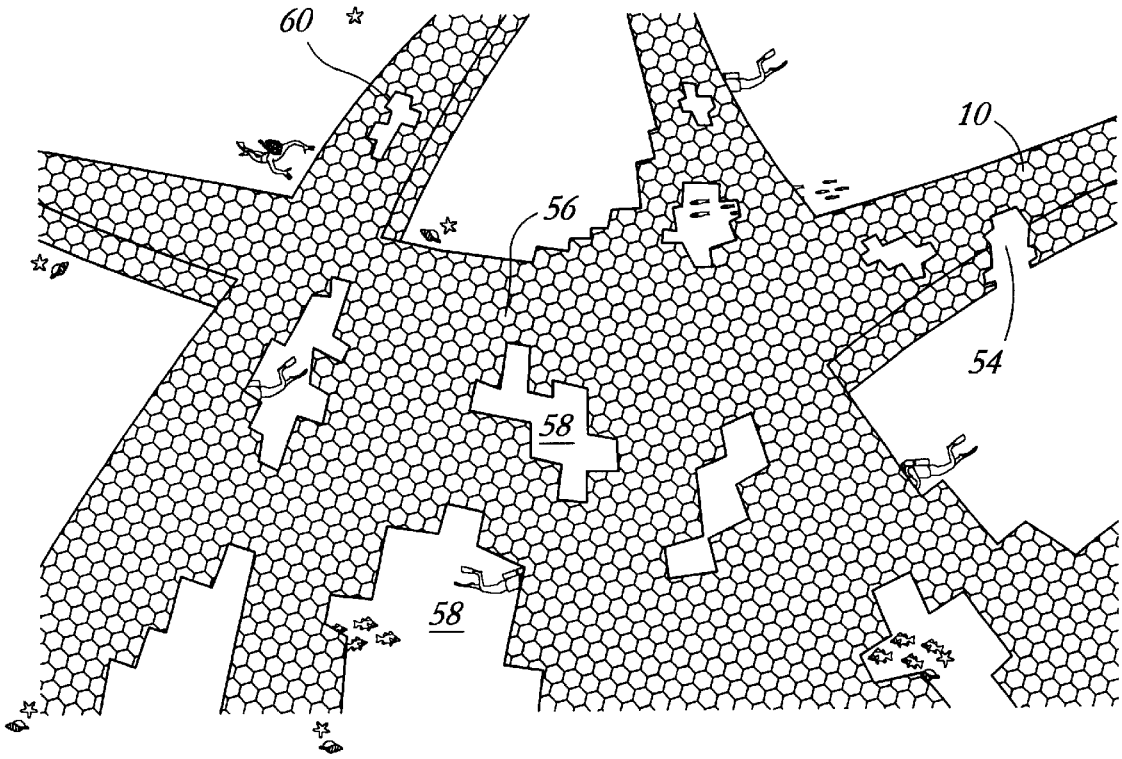
FIG. 6 is a perspective view of the interrelated catacomb sections, maze, and portals of a selected area in the preferred method of the invention.

Also, as shown in FIG. 6, the preferred embodiment of the invention comprises an underwater enclosed space 56. The interior of the enclosed space 56 is accessible to divers by the adjacent tunnels 50. In this sense, the catacomb system provides a series of unique caves and exotic passageways for exploration. As the marine habitat is enhanced over time with a variety of aquatic life, the effects can be dramatic. Any particular segment can incorporate unique entrances within the maze, providing dissimilar areas of reef sections.

Alternatively, the enclosed space 56 may be accessed through one or more intermediate openings 59. Tunnels 50 branching from the enclosed area 56 may also have intermediate openings 60 for divers.

It is preferred that the catacomb 36 be created as rapidly and efficiently as possible. In the preferred embodiment of the method of creation of the catacomb 36, a floating vessel 44 is used to carry the molds 12 for interlocking and/or stacking concrete modules 10. The vessel 44 may be powered or transported with the assistance of a barge or tug boat. Preferably, the vessel 44 has a gantry 46 or other means for accurately placing the concrete modules 10.

A concrete forming mixture 14 is intermixed and poured into the forms 12. One or more urns 16 containing cremated remains 62 are then interposed in each form 12 at least partway within the mixture 14. Once the mixture 14 sets, the discrete concrete modules 10 are created. The forms 12 are designed to have compatible and mating sections and surfaces, such that different pieces interlock with one another. Many shapes can be utilized for curved sections, to ease installation and transition areas.

The gantry 44 is then used to lower the concrete modules 10 underwater and to place the concrete modules 10 in an interlocking, and/or stacked orientation forming an underwater catacomb 36 with nooks 38, tunnels 40 and one or more enclosed areas 60.

Once the catacomb 36 has been constructed, the environment it provides will have an emotional impact on visitors 42. The shape of the catacomb 36 and the presence of cremated remains within the structure combine to evoke emotional responses on many levels from visitors 42. The unique combination of an underwater theme park, artificial reef, catacomb system and memorial creates an ambiance heretofore unparalleled. The tunnels and enclosed areas will provide added interest to visitors, thereby creating underwater attraction. The impact will be heightened when a large number of urns 16 are used in the creation of the catacomb 36. Enhancing the passageways with inscriptions and logos provides substantial emphasis on the tribute to others. The impact will also be heightened for the visitor 42 as more marine creatures use the catacomb 36 as a feeding ground or shelter.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An artificial underwater memorializing catacomb and reef system for memorializing a person and providing an evocative environment for a visitor, comprising:

a plurality of generally solid concrete modules;

one or more urns permanently imbedded at least partway within one or more of the concrete modules such that the one or more urns are irremovable from the concrete module upon solidification of concrete forming the module; and cremated remains located within the urns, whereby the concrete modules are interlocked to form at least one passageway that can be entered by the visitor.

2. The system of claim 1, wherein the passageway includes portals for visitors or marine life to enter or exit.

3. The system of claim 1, wherein the module is marked to identify the remains within the imbedded urn.

4. The system of claim 1, wherein the passageway forms part of a maze.

5. The system of claim 1, wherein the concrete modules are further stacked.

6. The system of claim 1, wherein the passageway further comprises one or more arches, whereby a visitor may enter additional passageways through the arches.

7. The system of claim 6, whereby the passageway further include one or more underwater enclosed spaces whereby a visitor is able to access the spaces from the passageway.

8. The system of claim 1, wherein a plurality of passageways branch at one or more intersections to form a catacomb.

9. An underwater theme park catacomb for memorializing a person and providing an evocative environment for visitors, comprising:

a plurality of interocking concrete modules at least one of which fixedly imbeds one or more urns, each urn including cremated remains, wherein each urn is located at least partway within the module such that the one or more urns are irremovable from the concrete module upon solidification of concrete forming the module.

10. The theme park catacomb of claim 9, wherein the concrete modules are interlocking and stackable.

11. The theme park catacomb of claim 9, wherein the concrete modules are interlocked so that they may form one or more passageways.

12. The theme park catacomb of claim 11, wherein the concrete modules are interlocked so that they may form a maze.

13. The theme park catacomb of claim 9, wherein the concrete modules are interlocked so that they may form underwater enclosed spaces accessible to an underwater visitor.

14. The theme park catacomb of claim 9, wherein the catacomb is configured in the shape of a logo that is recognizable from the surface of the water.

15. An underwater attraction providing a habitat for marine wildlife and an evocative environment for a visitor, comprising:

interlocking concrete modules;

one or more urns imbedded at least partway within one or more of the concrete modules such that the one or more urns are irremovable from the concrete module upon solidification of concrete forming the module; and cremated remains located within the urns.

16. The underwater attraction of claim 15, wherein the concrete modules are interlocked to form a catacomb.

17. The underwater attraction of claim 15, wherein the concrete modules are interlocked and stacked to form a catacomb.

18. The underwater attraction of claim 17, wherein the catacomb comprises one or more tunnels whereby a visitor may be enclosed by the modules.

19. The underwater attraction of claim 17, wherein the catacomb comprises one or more nooks.

20. An article of manufacture for building an underwater structure, comprising:

an interlocking concrete module having at least one cavity therein:

an urn fixedly located at least partway within the cavity such that the one or more urns are irremovable from the concrete module upon solidification of concrete forming the module; and cremated remains located within the urn.

21. The article of claim 20, wherein the module comprises a shape whereby the module can be stacked and interlocked with other modules.

22. The article of claim 21, whereby interlocked modules create a catacomb.

23. The article of claim 20, wherein the underwater structure includes one or more tunnels accessible to an underwater visitor.

24. The article of claim 20, wherein the underwater structure includes one or more enclosed areas wherein the enclosed areas are accessible to an underwater visitor.

* * * * *